US008377260B2

(12) United States Patent
Nonomura et al.

(10) Patent No.: US 8,377,260 B2
(45) Date of Patent: Feb. 19, 2013

(54) NEWSPRINT PAPER FOR OFFSET PRINTING

(75) Inventors: Fuminari Nonomura, Tokyo (JP); Tomohiro Higata, Tokyo (JP); Yasunori Nanri, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 13/212,722

(22) Filed: Aug. 18, 2011

(65) Prior Publication Data

US 2011/0303377 A1 Dec. 15, 2011

Related U.S. Application Data

(60) Division of application No. 12/683,738, filed on Jan. 7, 2010, now abandoned, which is a continuation of application No. 10/550,132, filed as application No. PCT/JP2004/003930 on Mar. 23, 2004, now abandoned.

(30) Foreign Application Priority Data

Mar. 25, 2003 (JP) ..... 2003-83046

(51) Int. Cl.
*D21H 17/67* (2006.01)
*D21H 11/14* (2006.01)
*D21H 19/20* (2006.01)

(52) U.S. Cl. ..... 162/181.2; 162/135; 162/147; 162/158

(58) Field of Classification Search ..... 162/135–136, 162/141, 147, 149, 181.1–181.2, 158, 164.1
See application file for complete search history.

(56) References Cited

U.S. PATENT DOCUMENTS

| | | | | | |
|---|---|---|---|---|---|
| 3,873,336 | A | * | 3/1975 | Lambert et al. | 106/464 |
| 5,076,846 | A | | 12/1991 | Buri et al. | |
| 5,126,014 | A | | 6/1992 | Chung | |
| 5,147,507 | A | | 9/1992 | Gill | |
| 5,156,719 | A | * | 10/1992 | Passaretti | 162/158 |
| 5,169,441 | A | * | 12/1992 | Lauzon | 106/416 |
| 5,505,819 | A | | 4/1996 | De Witt et al. | |
| 5,527,430 | A | * | 6/1996 | Gill | 162/158 |
| 5,527,852 | A | | 6/1996 | Maruyama et al. | |
| 5,593,488 | A | * | 1/1997 | Wu | 106/464 |
| 5,647,902 | A | * | 7/1997 | Wu | 106/464 |
| 5,695,733 | A | * | 12/1997 | Kroc et al. | 423/432 |
| 5,698,305 | A | | 12/1997 | Suzuki et al. | |
| 5,750,253 | A | | 5/1998 | Satake et al. | |
| 5,755,930 | A | | 5/1998 | Salterfield et al. | |
| 5,827,398 | A | | 10/1998 | Depasquale et al. | |
| 5,919,424 | A | | 7/1999 | Klyosov et al. | |
| 6,072,309 | A | | 6/2000 | Watson et al. | |
| 6,214,166 | B1 | | 4/2001 | Munchow | |
| 6,458,413 | B1 | | 10/2002 | Hirabayashi et al. | |
| 6,887,351 | B1 | * | 5/2005 | Lunden et al. | 162/181.2 |
| 7,033,428 | B2 | * | 4/2006 | Drummond | 106/464 |
| 7,311,801 | B2 | | 12/2007 | Ono et al. | |
| 7,691,231 | B2 | | 4/2010 | Ono et al. | |
| 2002/0121351 | A1 | | 9/2002 | Takano et al. | |
| 2003/0073363 | A1 | | 4/2003 | Ono et al. | |
| 2004/0177938 | A1 | | 9/2004 | Ono et al. | |
| 2005/0098066 | A1 | * | 5/2005 | Lunden et al. | 106/464 |
| 2006/0257635 | A1 | | 11/2006 | Nonomura et al. | |
| 2009/0162642 | A1 | | 6/2009 | Ono et al. | |
| 2010/0108280 | A1 | | 5/2010 | Nonomura et al. | |
| 2010/0170650 | A1 | * | 7/2010 | Ishioka et al. | 162/168.1 |
| 2011/0146931 | A1 | * | 6/2011 | Gane et al. | 162/181.2 |
| 2011/0303377 | A1 | * | 12/2011 | Nonomura et al. | 162/181.6 |

FOREIGN PATENT DOCUMENTS

| | | | |
|---|---|---|---|
| CA | 2324459 | A1 | 9/2000 |
| JP | 03-167392 | | 7/1991 |
| JP | 08-506860 | | 7/1996 |
| JP | 09-078491 | A | 3/1997 |
| JP | 2001-262485 | A | 9/2001 |
| JP | 2002-507675 | A | 3/2002 |
| JP | 2002-113940 | A | 4/2002 |
| JP | 2002-113941 | A | 4/2002 |
| JP | 2002-201590 | A | 7/2002 |
| JP | 2002-227090 | A | 8/2002 |
| JP | 2002-294587 | A | 10/2002 |
| JP | 2003-082599 | A | 3/2003 |
| SU | 1172971 | A | 8/1985 |
| WO | WO 01/94699 | A1 | 12/2001 |
| WO | WO 2004/085742 | A1 | 10/2004 |

OTHER PUBLICATIONS

Penniman et al., "papermaking Performance of Ground Limestone and Other Fillers," 1983, Alkaline Papermaking, pp. 41-61.
Gary A. Smook, 3rd Edition Handbook for Pulp & Paper Technologists, Chapter 15, Angus Wilde Publications Inc., pp. 220-226, 2002.
Office Action issued by the Canadian Patent Office dated Nov. 30, 2010 for the counterpart Canadian Patent Application No. 2,520,430.

* cited by examiner

*Primary Examiner* — Jose A Fortuna
(74) *Attorney, Agent, or Firm* — Knobbe, Martens, Olson & Bear LLP

(57) ABSTRACT

A method of manufacturing a newsprint paper for offset printing, includes: selecting a filler or fillers having an average grain size of 0.5 to 5 μm and a zeta potential of 0 mV or above; providing a pulp slurry for making a base paper; adding the filler or fillers to the pulp slurry in an amount of more than 15 percent by weight but less than 40 percent by weight as ash relative to the dry weight of the base paper; and subjecting the resultant slurry to a papermaking machine to obtain the base paper.

5 Claims, No Drawings

NEWSPRINT PAPER FOR OFFSET PRINTING

CROSS-REFERENCE TO RELATED APPLICATIONS

This application is a divisional application of U.S. patent application Ser. No. 12/683,738, filed Jan. 7, 2010, now abandoned, which is a continuation application of U.S. patent application Ser. No. 10/550,132, filed Apr. 28, 2006, now abandoned, which is the U.S. National Phase under 35 U.S.C. §371 of International Application PCT/JP2004/03930, filed Mar. 23, 2004, which claims priority to Japanese Patent Application No. 2003-83046, filed Mar. 25, 2003. Each disclosure of the U.S. Patent Applications is herein incorporated by reference in its entirety. The International Application was published under PCT Article 21(2) in a language other than English.

BACKGROUND

1. Field of the Invention

This invention relates to a newsprint paper for offset printing that offers excellent printing efficiency and print quality in offset printing.

2. Description of Related Art

Newsprint paper have become lighter by approx. 8 g/m$^2$ over the past ten years or so, and some large users are now using extra-light newsprint papers weighting 40.5 g/m$^2$. Use of color printing has also accelerated in the past several years, as the development of tower-press printing machines enabled double-face printing in color. As much as a half of all newsprint paper pages may be printed in color in a near future.

These trends reflect the strong demands for quality newsprint papers that are growing every year. In particular, there is a high demand for papers that can suppress show-through (lack of opacity of a printed paper; i.e., a phenomenon where the characters and illustrations printed on the other side are shown). Several methods are available to suppress show-through. Among them, the most effective method is to use pulps and/or fillers offering high specific scattering coefficients (a high specific scattering coefficient indicates less transmission of light). Among various pulps, mechanical pulp has a high specific scattering coefficient. However, the content of mechanical pulp has been decreasing of late due to an increase in the content of deinked pulp (DIP). As a result, suppressing show-through by means of changing the ratios of component pulps is becoming difficult. Because of this, increasing the content of fillers than that of fibers has emerged as an effective way to improve the opacity of paper. Accordingly, attempts have been made to increase the filler content in paper.

The DIP content in newsprint papers is increasing every year, as the users become more environmentally conscious and the paper manufacturers drive further cost reduction, among other reasons. Currently, it is not rare to find a newspaper containing over 70% of DIP. However, an increase in the DIP content results in various quality problems, such as reduced paper thickness and lower strength. In offset printing, a high DIP content can cause blurred ruled lines and roughness on solid areas due to paper powder deposit. Among these problems, paper powder deposit not only reduces print quality, but it also affects the printing efficiency because a large amount of paper powder deposited on the blanket cylinders of the press prolongs the cleaning time for the cylinders. Newspaper companies have successfully increased and continue to increase the printing speed and volume in recent years through adoption of online editing, advanced direct plate-making technology, etc. Therefore, conduciveness to printing efficiency is one of the key quality features that newspaper companies look for in material papers. A large amount of paper powder deposit necessitates frequent stopping of the press to clean the blanket cylinders. If the cleaning time becomes longer by several tens of minutes, the newspaper delivery will be affected and the readers will complain. This is why newspaper companies are particularly concerned about the problem of paper powder deposit.

As explained above, the most effective way to suppress show-through is to increase the filler content in the material newspaper. However, increasing the filler content generally lowers the surface strength and tensile strength of paper and also reduces the thickness of paper. In particular, lower surface strength allows more paper powder to deposit on the blanket cylinders of the web rotary offset press in offset printing, and the deposited paper powder causes blurred characters and ruled lines or roughness on solid areas (consequently poor ink impression). Normally, increasing the content of white carbon, talc, kaolin and other fillers in the material newsprint paper is known to increase the generation of paper powder. Since most of the ash content of DIP comes from fillers, the amount of paper powder entering the paper may also increase, in which case the higher powder content will cause other problems.

Generation of paper powder has been prevented by various means, such as blending pulps offering high surface strength, adding paper strengthening agents in the material mixture or coating oxidized starch on the produced paper. However, none of these methods can effectively suppress generation of paper powder.

For example, a technology has been presented in which 0.7 to 2.0 g/m$^2$ of modified starch is applied on each side of the paper to reduce paper powder generation (refer to Publication of Unexamined Patent Application No. 2002-294587). If the amount of coated starch is increased, however, the damping water used in offset printing will add stickiness to the paper surface, which is undesirable. In addition, the effects of paper powder deposit on blurred ruled lines and poor ink impression on solid areas have not been evaluated accurately because of the absence of physical properties that can be used to control the generation of paper powder.

BRIEF SUMMARY

In light of the conditions explained above, the present invention aims to provide a newsprint paper for offset printing that, despite a high DIP content, suppresses show-through in offset printing and also reduces paper powder deposit on the blanket cylinders of the press.

After diligently examining the causes of show-through in offset printing and generation of paper powder, the inventors discovered that the interaction of fibers and fillers at the paper surface has significant impact on the generation of paper powder. This discovery led to the idea that a newsprint paper for offset printing can be created that would suppress show-through when a filler or fillers are added by more than 15 percent by weight but less than 40 percent by weight as ash relative to the paper weight, and that such paper would suppress generation of paper powder if the filler or fillers—use of calcium carbonate is preferred—have an average grain size of 0.5 to 5 μm and a zeta potential of 0 mV or above in a state dispersed in water.

DETAILED DESCRIPTION

A newsprint paper for offset printing that suppresses show-through was successfully created by adding a filler or fillers by more than 15 percent by weight but less than 40 percent by weight as ash relative to the paper weight. In particular, such newsprint paper for offset printing notably suppresses show-through and also reduces generation of paper powder if the filler or fillers have an average grain size of 0.5 to 5 μm and a zeta potential of 0 mV or above in a state dispersed in water. If two or more different fillers are added, the average grain size and zeta potential should be measured as the total values of the filler mixture.

In general, the surface strength of a paper is mainly determined by the strength of the fibers comprising the paper. It is believed that a paper becomes weaker in proportion to the rate of increase in its filler content relative to the fiber content. However, the inventors found that the interaction of fibers and fillers has significant impact on the surface strength of paper and that the grain size, electric charge and hydrophilicity of fillers affect the surface strength of paper, as long as the paper contains ash. It is widely known that paper has a porous structure. Because of this porous structure, a filler whose grains are larger produces more irregularities on the paper surface and thereby reduces the surface strength of paper. Also, adding an anionic filler to an anionic fiber (anionic property is characterized by a negative charge and a zeta potential of below 0 mV) reduces the surface strength of paper than when a cationic filler is added (cationic property is characterized by a positive charge and a zeta potential of 0 mV or above), because the anionic filler and anionic fiber create a weaker electrical bond.

Any fillers that are commonly used in papermaking can be used with the present invention, such as calcium carbonate, white carbon, talc, kaolin, illite and titanium oxide. For the reasons mentioned above, however, calcium carbonate with an average grain size of 0.5 to 5 μm is desirable. Among the different types of calcium carbonate, precipitated calcium carbonate (PCC) that is produced using chemical methods such as the carbonic acid gas method and carbonate solution method is preferred. In particular, the type of PCC produced on-site in the papermaking plant and added to the paper material as slurry is more preferable, because it contains no dispersant and whose zeta potential is 0 mV or above.

As for the papermaking machine used to produce the newsprint paper for offset printing as proposed by the present invention, a gap former papermaking machine, hybrid former papermaking machine or on-top former papermaking machine, each of which has a dewatering mechanism on both sides, is desirable. However, the choice is not limited to these machines.

As for the pulp material of the newsprint paper for offset printing as proposed by the present invention, there are no limitations and any pulps commonly used as paper material, such as ground pulp (GP), thermomechanical pulp (TMP), chemi-thermomechanical pulp (CTMP), deinked pulp (DIP) and softwood kraft pulp (NKP), can be used.

The smoothness, friction coefficient and other properties of the obtained newsprint paper for offset printing are deemed sufficient as long as they are equivalent to those of a regular newspaper used for offset printing.

The clear coat used in the present invention can be selected from: starch; oxidized starch, esterized starch, etherized starch, cationic starch, enzyme modified starch, aldehyde starch, hydroxyethyl etherized starch and other modified starches; carboxymethyl cellulose, hydroxyethyl cellulose, methyl cellulose and other cellulose derivatives; polyvinyl alcohol, carboxyl modified polyvinyl alcohol and other modified polyvinyl alcohols; or styrene-butadiene copolymer; polyvinyl acetate; vinyl chloride-vinyl acetate copolymer; polyvinyl chloride; polyvinylidene chloride; polyacrylic ester; and polyacrylamide. Such clear coat may be applied as an aqueous solution containing adhesive or water-soluble latex. It is also possible to simultaneously coat a surface sizing agent made of styrene-acrylate copolymer, styrene-maleiate copolymer, olefin compound, alkylketene dimmer, alkenyl succinic anhydride, etc.

As for the agents added to the paper material, dry strengthening agents such as polyacrylamide and cationic starch, or wet strengthening agents such as polyamide amine epichlorohydrin resin can be added.

The following explains the present invention in more details by using examples and comparative examples. Note, however, that the present invention is not limited to these examples.

In the examples and comparative examples, the percent (%) values indicate percents by weight, unless otherwise specified.

The fillers used in the examples and comparative examples were measured using the methods specified below to determine their grain sizes and zeta potentials. The newsprint papers for offset printing obtained in the examples and comparative examples were also evaluated using the methods specified below to determine their opacity, ash content, show-through, paper powder and blurriness of ruled lines.

<Measuring Method of Filler Grain Size>

The average grain size of each filler was measured using the Mastersizer S grain-distribution measuring device manufactured by Malvern Instruments. In the examples and comparative examples where two or more different fillers are used, the indicated average grain size represents that of the filler mixture.

<Measuring Method of Zeta Potential>

The zeta potential of each filler was measured using Zeta Sizer 3000HS manufactured by Malvern Instruments based on the electrophoresis method. In the examples and comparative examples where two or more different fillers are used, zeta potential of the filler mixture was measured.

<Opacity>

Opacity was measured in accordance with JIS P8138.

<Measuring Method of Ash Content in Paper>

The ash content in each paper was measured in accordance with JIS P8128. In the measurement of ash content in the papers containing calcium carbonate as a filler, the burning temperature was set to 575° C. In the measurement of ash content in the papers containing a filler or fillers other than calcium carbonate, the burning temperature was set to 900° C.

<Evaluation Method of Paper Powder, Show-Through and Blurriness of Ruled Lines>

As for paper powder, 60,000 copies were printed on Toshiba's web rotary offset press at a printing speed of 900 rpm and using a single colored ink, and then the paper powder deposited on the blanket cylinders was scraped off and weighed. The measured value is indicated as weight per 100 $cm^2$. The film thickness of dampening water was adjusted to 0.9 μm. As for show-through, whiteness of a solid area was observed on a copy obtained after 60,000 copies and compared with a white paper. The result was indicated by ⊙ (no difference was observed visually), ○ (little difference was observed), Δ (some difference was observed) or × (notable difference was observed). Blurriness of ruled lines was evaluated by observing the lines on a copy obtained after 60,000 copies. The result was indicated by ⊙ (no blurriness at all), ○ (little blurriness), Δ (some blurriness) or × (notable blurriness).

EXAMPLE 1

A material pulp mixture was created by preparing a pulp slurry comprising newspaper deinked pulp (with a freeness of 120 ml; hereinafter referred to as "DIP"), thermomechanical pulp (with a freeness of 100 ml; hereinafter referred to as "TMP") and softwood kraft pulp (with a freeness of 520 ml; hereinafter referred to as "NKP") at ratios of 50:30:20, and then adding thereto a filler comprising calcium carbonate with an average grain size of 2.1 μm and zeta potential of 3.5 mV in such a way that the ash content relative to the absolute dry weight of the paper became 16%. The obtained mixture was then processed on a gap former papermaking machine at a speed of 900 m/min, and then a clear coat comprising oxidized starch (trade name: SK-20 manufactured by Nihon Cornstarch) was applied on the obtained base paper having a grammage of 43 g/m$^2$ using an on-machine sizing press coater in such a way that the coating weight became 0.4 g/m$^2$ on both the felt surface and the wire surface, to produce a newsprint paper for offset printing. The opacity and ash content of the obtained newsprint paper for offset printing were measured, and a printing test was conducted on a web rotary offset press to evaluate show-through, paper powder and blurriness of ruled lines. The results are shown in Table 1.

EXAMPLE 2

A newsprint paper for offset printing was produced in the same manner as in Example 1, except that, as fillers, calcium carbonate and talc were added by 16% and 3%, respectively, in ash content relative to the absolute dry weight of the paper. The opacity and ash content of the obtained newsprint paper for offset printing were measured, and a printing test was conducted on a web rotary offset press to evaluate show-through, paper powder and blurriness of ruled lines. The results are shown in Table 1.

The grain size and zeta potential of the filler mixture are also shown in Table 1.

EXAMPLE 3

A newsprint paper for offset printing was produced in the same manner as in Example 1, except that the ratios of DIP, TMP and NKP comprising the material pulp mixture were changed to 75:20:5 and that, as fillers, calcium carbonate and talc were added by 18% and 3%, respectively, in ash content relative to the absolute dry weight of the paper. The opacity and ash content of the obtained newsprint paper for offset printing were measured, and a printing test was conducted on a web rotary offset press to evaluate show-through, paper powder and blurriness of ruled lines. The results are shown in Table 1.

The grain size and zeta potential of the filler mixture are also shown in Table 1.

EXAMPLE 4

A newsprint paper for offset printing was produced in the same manner as in Example 3, except that no clear coat was applied on the paper. The opacity and ash content of the obtained newsprint paper for offset printing were measured, and a printing test was conducted on a web rotary offset press to evaluate show-through, paper powder and blurriness of ruled lines. The results are shown in Table 1.

The grain size and zeta potential of the filler mixture are also shown in Table 1.

EXAMPLE 5

A newsprint paper for offset printing was produced in the same manner as in Example 1, except that the ratios of DIP, TMP and NKP comprising the material pulp mixture were changed to 90:5:5 and that, as fillers, calcium carbonate and white carbon were added by 29% and 7%, respectively, in ash content relative to the absolute dry weight of the paper.

The opacity and ash content of the obtained newsprint paper for offset printing were measured, and a printing test was conducted on a web rotary offset press to evaluate show-through, paper powder and blurriness of ruled lines. The results are shown in Table 1.

The grain size and zeta potential of the filler mixture are also shown in Table 1.

EXAMPLE 6

A newsprint paper for offset printing was produced in the same manner as in Example 1, except that the ratios of DIP, TMP and NKP comprising the material pulp mixture were changed to 90:5:5 and that, as fillers, calcium carbonate and white carbon were added by 16% and 10%, respectively, in ash content relative to the absolute dry weight of the paper.

The opacity and ash content of the obtained newsprint paper for offset printing were measured, and a printing test was conducted on a web rotary offset press to evaluate show-through, paper powder and blurriness of ruled lines. The results are shown in Table 1.

The grain size and zeta potential of the filler mixture are also shown in Table 1.

EXAMPLE 7

A newsprint paper for offset printing was produced in the same manner as in Example 1, except that the ratios of DIP, TMP and NKP comprising the material pulp mixture were changed to 90:5:5 and that, as fillers, calcium carbonate and talc were added by 27% and 6%, respectively, in ash content relative to the absolute dry weight of the paper. The opacity and ash content of the obtained newsprint paper for offset printing were measured, and a printing.

COMPARATIVE EXAMPLE 1

A newsprint paper for offset printing was produced in the same manner as in Example 1, except that white carbon was added as a filler by 5% in ash content relative to the absolute dry weight of the paper. The opacity and ash content of the obtained newsprint paper for offset printing were measured, and a printing test was conducted on a web rotary offset press to evaluate show-through, paper powder and blurriness of ruled lines. The results are shown in Table 1. Paper powder and blurriness of lines were evaluated on offset printed copies and the results are shown in Table 1.

The grain size and zeta potential of the filler are also shown in Table 1.

COMPARATIVE EXAMPLE 2

A newsprint paper for offset printing was produced in the same manner as in Example 1, except that, as fillers, calcium carbonate and white carbon were added by 3% and 5%, respectively, in ash content relative to the absolute dry weight of the paper. The opacity and ash content of the obtained newsprint paper for offset printing were measured, and a printing test was conducted on a web rotary offset press to evaluate show-through, paper powder and blurriness of ruled lines. The results are shown in Table 1.

Paper powder and blurriness of ruled lines were evaluated on offset printed copies and the results are shown in Table 1.

The grain size and zeta potential of the filler mixture are also shown in Table 1.

COMPARATIVE EXAMPLE 3

A newsprint paper for offset printing was produced in the same manner as in Example 3, except that, as fillers, calcium carbonate and kaolin were added by 5% and 2%, respectively, in ash content relative to the absolute dry weight of the paper. The opacity and ash content of the obtained newsprint paper for offset printing were measured, and a printing test was conducted on a web rotary offset press to evaluate show-through, paper powder and blurriness of ruled lines. The results are shown in Table 1.

Paper powder and blurriness of ruled lines were evaluated on offset printed copies and the results are shown in Table 1.

The grain size and zeta potential of the filler mixture are also shown in Table 1.

COMPARATIVE EXAMPLE 4

A newsprint paper for offset printing was produced in the same manner as in Example 3, except that, as fillers, calcium carbonate and talc were added by 2% and 9%, respectively, in ash content relative to the absolute dry weight of the paper. The opacity and ash content of the obtained newsprint paper for offset printing were measured, and a printing test was conducted on a web rotary offset press to evaluate show-through, paper powder and blurriness of ruled lines. The results are shown in Table 1.

The grain size and zeta potential of the filler mixture are also shown in Table 1.

COMPARATIVE EXAMPLE 5

A newsprint paper for offset printing was produced in the same manner as in Example 5, except that, as fillers, calcium carbonate and talc were added by 5% and 7%, respectively, in ash content relative to the absolute dry weight of the paper. The opacity and ash content of the obtained newsprint paper for offset printing were measured, and a printing test was conducted on a web rotary offset press to evaluate show-through, paper powder and blurriness of ruled lines. The results are shown in Table 1.

The grain size and zeta potential of the filler mixture are also shown in Table 1.

COMPARATIVE EXAMPLE 6

A newsprint paper for offset printing was produced in the same manner as in Example 4, except that, as fillers, calcium carbonate, talc and white carbon were added by 1%, 5% and 8%, respectively, in ash content relative to the absolute dry weight of the paper. The opacity and ash content of the obtained newsprint paper for offset printing were measured, and a printing test was conducted on a web rotary offset press to evaluate show-through, paper powder and blurriness of ruled lines. The results are shown in Table 1.

The grain size and zeta potential of the filler mixture are also shown in Table 1.

TABLE 1

| | Ash content in paper (%) | Calcium carbonate content in paper (%) | Filler grain size (μm) | Filler zeta potential (mV) | Opacity (%) | Show-through | Paper powder generation (mg/100 cm$^2$) | Blurriness of ruled lines |
|---|---|---|---|---|---|---|---|---|
| Example 1 | 16 | 16 | 2.1 | 3.5 | 93 | ⊙ | 2 | ⊙ |
| Example 2 | 19 | 16 | 2.9 | 2.8 | 92 | ○ | 6 | ⊙ |
| Example 3 | 21 | 18 | 3.2 | 1.5 | 94 | ⊙ | 5 | ⊙ |
| Example 4 | 21 | 18 | 3.2 | 1.5 | 94 | ⊙ | 58 | Δ |
| Example 5 | 35 | 29 | 4.5 | 1.0 | 97 | ⊙ | 18 | ⊙ |
| Example 6 | 26 | 16 | 5.2 | −10.5 | 95 | ⊙ | 20 | ○ |
| Example 7 | 33 | 27 | 2.5 | −8.3 | 96 | ⊙ | 36 | ○ |
| Comparative Example 1 | 5 | 0 | 2.1 | −10.0 | 85 | X | 28 | ○ |
| Comparative Example 2 | 8 | 3 | 5.8 | 3.4 | 82 | X | 78 | X |
| Comparative Example 3 | 7 | 5 | 5.3 | 3.2 | 86 | X | 21 | ○ |
| Comparative Example 4 | 11 | 2 | 5.4 | −3.2 | 88 | X | 85 | X |
| Comparative Example 5 | 12 | 5 | 5.1 | −10.3 | 88 | X | 45 | Δ |
| Comparative Example 6 | 14 | 1 | 5.9 | −16.3 | 85 | X | 280 | X |

As shown in Table 1, the newsprint papers for offset printing obtained in Examples 1 through 7, which contained fillers by more than 15 percent by weight but less than 40 percent by weight as ash relative to the paper weight, offered high opacity and good show-through suppression. In particular, the newsprint papers for offset printing obtained in Examples 1, 2, 3 and 5, which contained fillers with a grain size of 0.5 to 5 μm and zeta potential of 0 mV or above and were also coated with a clear coat, generated less paper powder deposit on the blanket cylinders of the offset press and presented no blurriness of ruled lines. On the other hand, the newsprint papers for offset printing obtained in Comparative Examples 1 through 6, which contained fillers by less than 15 percent by weight relative to the paper weight, exhibited low opacity and insufficient suppression of show-through.

INDUSTRIAL FIELD OF APPLICATION

The present invention provides a newsprint paper for offset printing that offers good printing efficiency and print quality.

The newsprint paper for offset printing proposed by the present invention provides high opacity and good show-through suppression when it contains a filler or fillers by more than 15 percent by weight but less than 40 percent by weight as ash relative to the paper weight. In particular, the paper powder deposited on the blanket cylinders of the offset press can be reduced and blurriness of ruled lines can be eliminated by adding a filler or fillers with a grain size of 0.5 to 5 μm and zeta potential of 0 mV or above and also by applying a clear coat.

We claim:

1. A method of manufacturing a newsprint paper for offset printing in a papermaking plant, consisting of:

selecting fillers having an average grain size of 0.5 to 5 μm and being a mixture of fillers having a negative zeta potential and a positive zeta potential, wherein the total of the fillers has a zeta potential of 0 mV or above, said zeta potential being measured in a state dispersed in water, said fillers including precipitated calcium carbonate as produced on-site in the papermaking plant and containing no dispersant;

providing a pulp slurry for making a base paper;

adding the fillers to the pulp slurry for increasing an ash content of a resultant newsprint paper to more than 15 percent by weight but less than 40 percent by weight;

subjecting the resultant slurry to a papermaking machine to obtain the base paper; and making a newsprint paper for offset printing using the base paper.

2. The method according to claim 1, further comprising applying a clear coat on the base paper.

3. The method according to claim 1, wherein the fillers are a mixture of the precipitated calcium carbonate and talc or white carbon.

4. The method according to claim 1, wherein the pulp slurry contains a deinked pulp at a highest proportion among constituent pulps.

5. The method according to claim 1, wherein the zeta potential of the total of the fillers is between 1.0 mV and 1.5 mV.

* * * * *